United States Patent [19]

Brandenberger et al.

[11] 4,334,960

[45] Jun. 15, 1982

[54] PROCESS FOR TREATING PARTIALLY DESULFURIZED COKE

[75] Inventors: Kurt Brandenberger, Neuhausen; Alfred Feichtinger, Sins; Werner Fischer, Venthône, all of Switzerland

[73] Assignee: Swiss Aluminium Ltd., Chippis, Switzerland

[21] Appl. No.: 189,067

[22] Filed: Sep. 22, 1980

[30] Foreign Application Priority Data

Aug. 21, 1980 [CH] Switzerland ..... 6316/80

[51] Int. Cl.[3] ..... C10B 53/00; C10B 57/02

[52] U.S. Cl. ..... 201/17; 201/44; 264/29.7; 423/460

[58] Field of Search ..... 201/17, 44; 423/460, 423/461; 264/29.1, 29.2, 29.3, 29.4, 29.5, 29.6, 29.7; 44/1.5 R; 204/294

[56] References Cited

U.S. PATENT DOCUMENTS

| | | | |
|---|---|---|---|
| 2,805,199 | 9/1957 | Banes et al. | 204/294 |
| 4,100,265 | 7/1978 | Yoshimura et al. | 201/17 X |
| 4,146,434 | 3/1979 | Alford et al. | 201/17 |
| 4,160,814 | 7/1979 | Hardin et al. | 201/17 X |
| 4,203,960 | 5/1980 | Bauer et al. | 201/17 X |

*Primary Examiner*—Bradley Garris

*Attorney, Agent, or Firm*—Bachman and LaPointe

[57] ABSTRACT

The invention concerns a process for improving the strength properties of partially desulfurized coke, especially petroleum coke, and in such a way that it is then suitable as raw material for electrodes, in particular anodes for the fused salt electrolytic production of aluminum by the Hall Héroult process. The process according to the invention comprises an after-treatment of the partially desulfurized coke at an elevated temperature for a duration of at least 30 minutes, as a result of which the strength of the coke increases.

4 Claims, No Drawings

PROCESS FOR TREATING PARTIALLY DESULFURIZED COKE

BACKGROUND OF THE INVENTION

The invention relates to a process for improving the strength properties of partially desulfurized coke, especially petroleum coke which can be used to manufacture electrodes, in particular anodes for the Hall-Héroult fused salt electrolytic process for the production of aluminum. The process according to the invention comprises an after-treatment for partially desulfurized, calcined coke for at least 30 minutes at an elevated temperature, as a result of which there is an increase in the strength of the coke.

In the aluminum industry carbon based materials are employed for the production of aluminum, in particular anodes made out of calcined coke residue or green cokes which contain large amounts of sulfur. Whereas green coke containing about 3 wt.% sulfur was hardly ever used by the aluminum industry up to a few years ago, such coke is now widely used for reasons of costs and/or due to the shortage of better quality coke.

Cokes for the production of anodes for the aluminum smelters, often because of environmental laws but also because of cost factors related to the electrolytic process, must contain less than about 2 wt.% sulfur.

There has been no lack of efforts to develop processes for desulfurizing high sulfur cokes so that these cokes will, in terms of sulfur content, satisfy the necessary conditions, in particular those concerning the environment. In most countries the environmental laws permit $SO_2$ emissions in amounts which correspond to a concentration of 1.8 wt.% sulfur in the atmosphere. In the first phase of developments single stage processes were proposed, whereby the sulfur content was reduced to the required level by directly heating the green coke to temperatures of up to and over 1500° C.

However coke is required to satisfy other, important requirements if it is to be made into anodes for aluminum reduction cells. For example, the density and the physical strength should be as high as possible; on the other hand the reactivity towards $CO_2$ or air should remain sufficiently low. Also of importance is the crystallinity, electrical conductivity and purity.

It is therefore not surprising that various calcined cokes, which have been produced by processes aimed solely at lowering the sulfur content, were not able to satisfy these requirements.

In the following art processes which are mostly of the 2-stage kind, there results in a quality of coke which is suitable for anode manufacture. In the 1st stage, frequently in the temperature range below 1000° C., measures are taken to effect only insignificant desulfurization, and in the 2nd stage the final calcination of the coke takes place producing the required reduction in the sulfur content, at the same time however fulfilling some part of the requirements with respect to the above mentioned properties. Therefore, for example, according to the German published patent application 29 03 884 about 70% of the volatile constituents is removed in the first stage in the temperature range of ~490° C. to approximately 850° C., and in the second stage calcination is carried out at a temperature of at least 1500° C. so that the largest part of the sulfur is removed without substantially altering the bulk density of the coke. This process is in the first instance directed only at the bulk density of the coke, and ignores the essential, important property of physical strength of the coke. It can be said in general about the 2-stage process for desulfurizing green cokes that the procedures are very involved, which results e.g. in the quality fluctuating strongly from charge to charge. Another disadvantage is the much higher price of the end product compared with that from single stage processes.

SUMMARY OF THE INVENTION

It is an object of the invention to change the inadequate properties of calcined cokes, in particular that from single stage processes, in such a way by an after-treatment that the resultant cokes meet the requirements of the aluminum industry.

This object is achieved by way of the invention in that partially desulfurized coke with a sulfur content of $\leqq 2$ wt.% and inadequate particle strength is subjected to an after-treatment of heating for at least about 30 minutes in a temperature range of 1300°–1600° C. to achieve an adequate strength.

Surprisingly as a result of the after-treatment according to the invention viz., heating to beyond the actual range for desulfurizing, the improvement in the physical strength is achieved along with almost unchanged density. This improvement makes it possible to employ the, in general, inadequate calcined cokes to manufacture anodes for the aluminum industry.

DETAILED DESCRIPTION

On carrying out the process according to the invention it turned out that one coke, which satisfied the legal requirements with respect to sulfur content but is unsuitable for the manufacture of anodes as the mechanical properties are inadequate, can have its strength properties raised to a sufficient degree by treating the coke for at least 30 minutes at a temperature which can be lower than the temperature at which the desulfurization was carried out but, is preferably the same or higher than the desulfurization temperature.

It is, in general, not possible to give exact details of the temperature for the after-treatment and the duration of the treatment as the calcined cokes, depending on their origin, require different treatments and the most favorable parameters have to be determined by trials. Unnecessary and therefore out of the question are temperatures which are so high that the cokes would undergo such pronounced structural changes that they would graphitize to a greater or lesser extent i.e. temperatures above about 1600° C. should, according to the process of the invention, not be employed. Very high temperatures are also out of the question as they make the basically simple and economic process of the invention more expensive and therefore are counter-productive to achieving the purpose of the invention.

The physical strength of the coke is determined by the particle strength. This is expressed as the amount of particulate material, in weight percent, coke which remains as residue on a sieve of specific mesh size after being subjected to mechanical loading.

The particle strength was determined using a Vibratom ball grinder from the firm Siebtechnik GmBH Muehlheim, West Germany, the 0.3 liter capacity steel container of which was filled with 1000 gram steel balls of 9–10 mm diameter and 100±0.1 gram of the calcined coke which was to be tested and which had a particle size of 8–4 mm. For the test the ball grinder was allowed to run for 3.5 minutes ± 2 seconds. The sample for testing was prepared by taking 1500 gram of homogenized but not crushed calcined coke, sieving for 10 minutes and then drying it at up to 120° C.±2° C. until no weight change took place. After quartering, the sample was taken from one fraction of the total.

After the crushing, the contents of the steel container were transferred to an 8 mm mesh sieve with a 4 mm mesh sieve below it and the crushed coke sieved by hand. The coke remaining in the 4 mm sieve was weighed and expressed as a percentage of the original amount of 100 gram. This is by definition the particle strength.

When the sulfur content of the coke is sufficiently low, its particle strength measured in the above manner is the decisive criterium for the coke to be used for anode manufacture. Desulfurized cokes with a particle strength of ≧70% are suitable for anode production. On the other hand processing desulfurized coke with lower strength values leads to anodes with unsatisfactory bend strength. Under the term desulfurized cokes is, in this connection, to be understood cokes with sulfur contents of ≦ approximately 2 wt.%, i.e. cokes which, with respect to sulfur content, would present no problem in anode production. As such this means almost always calcined coke coming from single stage desulfurization processes.

The invention is presented in further detail with the help of the results from the following trials:

Three different green cokes K1, K2 and K3, the sulfur contents of which were all over 3%, were all subjected to thermal treatments in which the time and temperature of treatment were varied and which can be considered as being equivalent to the above-mentioned single-stage kind of treatments. In each case the sulfur content and the strength of the cokes were determined.

The results are presented in the following table:

| Petroleum coke | Temperature °C. | Time min | S-content wt % | particle strength % |
|---|---|---|---|---|
| K 1 | 1100 | 120 | 3.05 | 52 |
| | 1350 | 120 | 3.01 | 78 |
| | 1450 | 120 | 1.72 | 67 |
| | 1570 | 90 | 0.47 | 77 |
| K 2 | 1100 | 120 | 3.07 | 47 |
| | 1350 | 120 | 2.32 | 76 |
| | 1600 | 120 | <0.1 | 58 |
| | 1600 | 240 | <0.1 | 81 |
| K 3 | 1100 | 120 | 4.39 | 88 |
| | 1250 | 120 | 1.42 | 69 |
| | 1350 | 50 | 0.23 | 85 |

The results, for example for coke K1, show that in comparison with the above mentioned conditions the particle strength after treatment at 1100° C. is too low, but after calcination at 1350° C. is adequate. On calcining at 1450° C. the sulfur content is acceptable. However the coke is not suitable for anode manufacture, as the particle strength has fallen below 70%. Only the after-treatment in accordance with the invention of 90 minutes at 1570° C. yields the necessary particle strength ≧70% thus making the coke suitable for anode manufacture. That the sulfur content has, at the same time, fallen to 0.47 wt.% is not significant and not essential for the invention.

The fall in particle strength on desulfurizing the coke to less than 2 wt.% is typical and is probably due to the micro-porosity and structural changes caused by the removal of the sulfur; these side effects have almost no effect on the bulk density of the coke. Measuring the bulk density of the coke is therefore an inadequate and not very suitable means of judging the quality of a calcined desulfurized petrol coke for the above mentioned application.

Coke K2 shows that the after-treatment both with respect to temperature and time is subject to strong fluctuations, depending on the kind of coke and the amount of sulfur given off. After coke K2 is treated at 1600° C. for 120 minutes it is almost sulfur-free. However, only after treatment at the same temperature for 240 minutes in accordance with the process of the invention does the coke reach a quality which is suitable for anode manufacture, and this without any significant further loss of sulfur. In this special case the process according to the invention could be described as tempering at the maximum temperature after this has been reached. It is, however, not the maximum temperature experienced by the coke which is essential but the subtle pairing of time and temperature.

Coke K3 is a coke which releases adequate amounts of sulfur at 1250° C. which, in this respect, can be considered as a very low temperature. As an after-treatment, to raise the strength which is just insufficient with this temperature, 50 minutes at 1350° C. proves to be adequate.

A conceivable mode of operation for an anode manufacture employing the process according to the invention is as follows: The incoming calcined coke of acceptable sulfur content, for example ≦1.8 wt.% sulfur, is tested for particle strength. If this is ≧70%, the coke can be passed for further processing. If the particle strength is below 70%, then the coke is subjected to the process according to the invention, whereby, as it is known from the trials that each coke behaves differently, the time and temperature to be employed with each coke has to be determined in preliminary trials. A further reduction in the sulfur content may occur as a result of the after-treatment according to the invention, but this is not a condition required by the invention.

What is claimed is:

1. A process for manufacturing partially desulfurized coke manufactured from green coke starting material for the production of anodes for the fused salt electrolytic production of aluminum to improve the particle strength thereof which comprises: heating coke having a sulfur content of greater than 2 weight percent to a temperature of about 1250° C. or higher so as to reduce the sulfur content to 2 weight percent or lower thereby obtaining partially desulfurized, calcined coke having low particle strength of less than 70 weight percent of coke which remains as residue on a sieve of specific mesh size after being subjected to mechanical loading which is inadequate for the manufacture of anodes, and treating said coke at a temperature of 1300°-1600° C. for at least 30 minutes to improve the particle strength to equal to or greater than 70 weight percent of coke which remains as residue on a sieve of specific mesh size after being subjected to mechanical loading with the resultant treated material having improved particle strength suitable for the manufacture of anodes, wherein said treatment is an after-treatment applied after the green coke has been subjected to partial desulfurization and calcination.

2. A process according to claim 1 wherein said partially desulfurized coke is petroleum coke.

3. A process according to claim 1 wherein the particle strength is improved with substantially unchanged density.

4. A process according to claim 1 wherein said desulfurizing heating step is a single stage desulfurization process.

* * * * *